US005230507A

United States Patent [19]

White et al.

[11] Patent Number: 5,230,507

[45] Date of Patent: Jul. 27, 1993

[54] GOLFING AID

[76] Inventors: William R. White, 15250 Gray Ridge #1028, Houston, Tex. 77082; Larry V. Davis, 112 Glenn Meadow La., Sealy, Tex. 77474

[21] Appl. No.: 862,963

[22] Filed: Apr. 3, 1992

[51] Int. Cl.[5] ..... A63B 57/00

[52] U.S. Cl. ..... 273/32 B; 273/32 E; 211/70.2; 248/96; 248/156; 224/268; 206/315.3; 206/315.6

[58] Field of Search ..... 273/32 B, 32 E; 211/70.2; 206/315.3; 248/96, 156; 224/268, 270, 274

[56] References Cited

U.S. PATENT DOCUMENTS

| | | | |
|---|---|---|---|
| D. 149,557 | 5/1948 | Jessen | 211/70.2 X |
| D. 279,309 | 6/1985 | Rosen et al. | D21/234 |
| 1,661,500 | 3/1928 | Reach | 273/32 E |
| 1,761,088 | 6/1930 | Pryde | 273/32 E |
| 2,465,096 | 3/1949 | Hunt | 211/70.2 |
| 2,520,226 | 8/1950 | Smith | 211/70.2 X |
| 2,595,987 | 5/1952 | Shears | 211/70.2 X |
| 2,621,799 | 12/1952 | Wilson | 211/70.2 |
| 2,858,868 | 11/1958 | Wallace | 273/32 E |
| 2,887,137 | 5/1959 | Robb | 273/32 E X |
| 3,954,239 | 5/1976 | Kerbs, Jr. | 248/96 |
| 4,036,416 | 7/1977 | Lowe | 224/45 R |
| 4,063,731 | 12/1977 | Kitay | 273/32 B |
| 5,116,046 | 5/1992 | Pace | 273/32 B |
| 5,127,530 | 7/1992 | Ortuno | 273/32 E X |
| 5,149,087 | 9/1992 | Thompson | 273/32 B |
| 5,152,524 | 10/1992 | Brown | 273/32 B |

OTHER PUBLICATIONS

Golfsmith Precision Golf Equipment, Putter Caddy Advertisement, Mar. 1992.

Austad's Spring 1992 Breakthrough, Hideaway Club Stand Advertisement, Spring 1992, p. 33.

Gulf Coast Golfer, Club Katt Advertisement from Foot Wedge, Inc., Apr. 1992, p. 19.

*Primary Examiner*—George J. Marlo

*Attorney, Agent, or Firm*—Pravel, Hewitt, Kimball & Krieger

[57] ABSTRACT

A golf club supporting apparatus is disclosed. The golf club supporting apparatus includes a base member having a lower portion including two spaced apart points contacting the ground and an upper portion connected to a shaft receiver. The shaft receiver includes a notched opening for receiving a shaft of the club being supported. The shaft is placed into the notched opening and a head of the club rests on the ground. The lower portion of the base member and the golf club head rest on the ground such that the golf club shaft is supported in a generally upright position. A clip is provided on the base member for attaching same to the upper rim of a golf bag.

The method of using the golf club supporting apparatus includes the steps of inserting the golf club shaft in the notched opening of the supporting apparatus and sliding the golf club tapered shaft down the notched opening until the tapered shaft is firmly engaged by the notched opening. The golf club head and the supporting apparatus is then placed on a ground surface.

7 Claims, 2 Drawing Sheets

GOLFING AID

FIELD OF THE INVENTION

The present invention relates to golfing, and more particularly to a method and apparatus for supporting a golf club in a partially upright position.

BACKGROUND OF THE INVENTION

Golfing has been one of the fastest growing sports in recent years. The sport of golfing is extremely popular, not only in the United States, but also in many foreign countries, such as Canada and Japan.

Various types of devices or paraphernalia have been developed to provide a golfer a more pleasurable round of golf. Although a round of golf may be played by one walking the course and carrying one's bag, a substantial number of golfers ride in an electric or gasoline powered golf cart or walk the course pulling a pull cart. In some instances when a golf cart is used, the cart is required to stay on a cart path especially constructed for the cart. The cart is not allowed to traverse fairways or greens. In other instances, a golf cart is allowed to travel on fairways, but is restricted to the cart path around the tee areas and greens.

One problem that arises during use of a golf cart is when the golfer must leave the cart and walk to his ball in order to take a shot. If the ball is in the fairway, the golfer must walk from the cart path to the fairway to where his ball has landed. In many cases, the golfer will take two or more clubs to the ball's location and decide when he reaches that location which club to use for his next shot. In other cases, when the ball has landed off, but near, the green, the golfer will usually take a putter and one or more other clubs such as a wedge with him to the ball's location. Taking a number of clubs at once eliminates taking a shot and placing the ball onto the green and then having to walk back and retrieve the putter for a subsequent putt.

Similarly, golf pull carts are not generally permitted on the greens. Golfers must leave the pull carts some distance from the green while they chip or pitch onto the green and putt out the hole using a couple of different clubs. Typically, in these situations the golfer must place the club or clubs that he is not using on the ground while taking his shot. Many golf clubs are left lying on the ground, partially hidden by the grass, and lost by golfers who fail to pick up clubs after putting out the hole.

Another problem with placing golf clubs directly on the ground is avoiding moisture and dirt on the grip. During morning hours, the fairways and greens of a golf course are generally damp from early morning dew or from the previous night's watering of the fairways and greens. Also, a recent shower of rain will dampen the fairways and greens without discouraging golfers from going out and playing a round of golf. Thus, if a golfer brings two or more clubs to where his ball landed, the golfer generally must put the additional clubs on the ground while taking his shot. This results in the grips of the clubs becoming damp and wet, thus requiring that these grips be cleaned and/or dried before use.

Also some golfers do not enjoy the stooping and bending over to pick up golf clubs on the ground. Many golfers are elderly or have some physical limitation which hampers or restricts this stooping or bending.

U.S. Design Pat. No. D279,309 to Rosen et al. discloses two parallel prongs, presumably for insertion into the ground, and a cradle support piece for apparently resting the shaft of the golf club. U.S. Pat. No. 4,036,416 to Lowe discloses a foldable A-frame golf club carrier for use in carrying, stowing and transporting golf clubs. U.S. Pat. No. 3,954,239 to Kerbs, Jr. discloses a carrier including a bottom support tier and intermediate and upper tiers having aligned openings or slots adapted to receive golf club shafts. The carrier includes a pointed member for insertion into the ground to position the carrier.

It is desirable to have a lightweight and low cost golf club support device which maintains one or more golf clubs in a partially upright position to make the club more visible to minimize the risk of loss. It is also desirable to have a lightweight and low cost golf club support device which supports a club or clubs such that the grips do not get wet or dirty. Furthermore, it is desirable to have a golf club support device which maintains the club or clubs substantially upright to minimize or eliminate any stooping or bending over to pick up additional clubs which have been removed from the golf bag.

SUMMARY OF THE INVENTION

The present invention comprises a golf club supporting apparatus which can be used to support a golf club in a substantially upright position. Supporting the golf club in a substantially upright position reduces the possibility of the golfer losing the club and reduces dirt and moisture on the grip. Furthermore, the golf club supporting apparatus eliminates the golfer's stooping or bending over to pick up the clubs on the ground.

Advantageously, the supporting apparatus engages the shaft of the golf club, so the supporting apparatus is picked up off the ground when retrieving the club. The golf club supporting apparatus includes a base member having a lower portion which contacts the ground and an upper portion which connects to a shaft receiver. The shaft receiver includes a notched opening for receiving the shaft of the club to be supported.

In use, the shaft of the golf club is placed into the notched opening and the head of the club rests on the ground. The shaft and the base member are used to mutually support each other and maintain the golf club in a substantially upright position. The upper portion of the base member also includes one or more recesses to support additional clubs, if needed.

BRIEF DESCRIPTION OF THE DRAWINGS

The objects, advantages and features of the invention will become more apparent by reference to the drawings which are appended hereto and wherein like numerals indicate like parts and wherein an illustrated embodiment of the invention is shown, in which.

DETAILED DESCRIPTION OF THE PREFERRED EMBODIMENT

Figure 1:
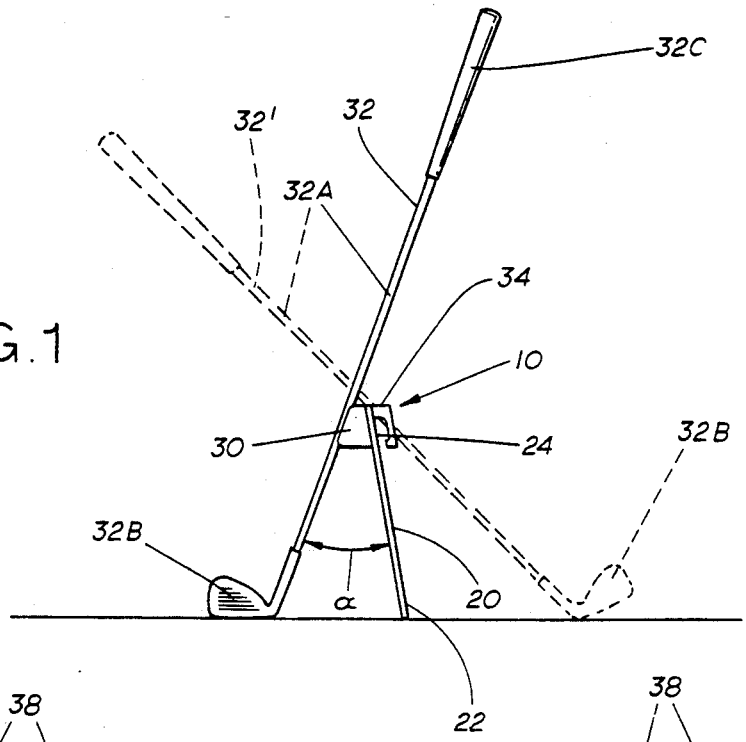
FIG. 1 is a side elevational view of the golf club supporting apparatus according to the present invention being used to support a golf club, also illustrated is a phantom view of a second supported golf club.

Referring now to FIG. 1, the golf club supporting apparatus, designated generally as 10, is shown supporting a conventional golf club 32. FIG. 1 shows a phantom view of a second golf club 32' resting on the supporting apparatus 10. As will be explained below, when using the supporting apparatus 10 to support a single golf club, this is accomplished by using the supporting apparatus in the manner as shown with the solid line showing of the golf club 32.

Figure 2:
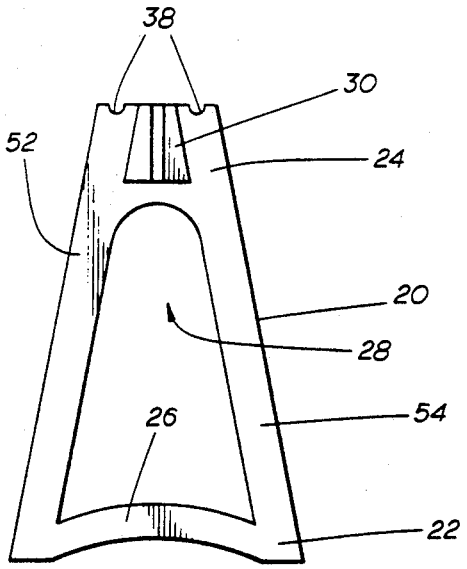
FIG. 2 is a front view of the golf club supporting apparatus of FIG. 1.
Figure 3:
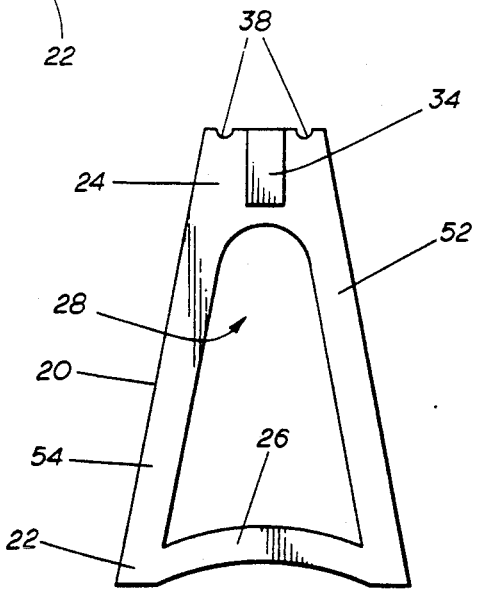
FIG. 3 is a rear view of the golf club supporting apparatus of FIG. 1.

The golf club supporting apparatus 10 includes a base member 20 having a lower portion 22 and an upper portion 24. The base member 20, as shown in FIGS. 1–4, is substantially flat and is preferably made from a sturdy, lightweight plastic to provide adequate stiffness with a minimum amount of weight. Referring to FIGS. 2 and 3, the base member 20 includes two side members 52 and 54 whose lower ends are joined by a bottom member 26. Preferably, the base member 20 is molded as one monolithic piece. As shown in FIGS. 2 and 3, the base member 20 has a central opening 28 which reduces the weight of the supporting apparatus 10 and also reduces the wind loading which may be exerted on the supporting apparatus 10, thus, providing a more stable support for the golf club 32. In addition, various other ways of fashioning the base member 20 may be used and all such variations are contemplated by the invention. The base member 20 is preferably configured such that the lower ends of the two side members 52 and 54 contact the ground surface with the bottom member 26 slightly raised above the two lower ends. This provides a more stable base when positioned on unlevel ground.

Figure 6:
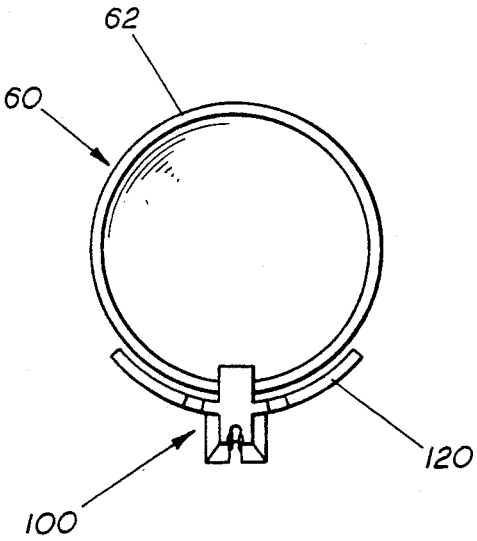
FIG. 6 is a plan view of the golf club supporting apparatus of FIG. 5.
Figure 5:
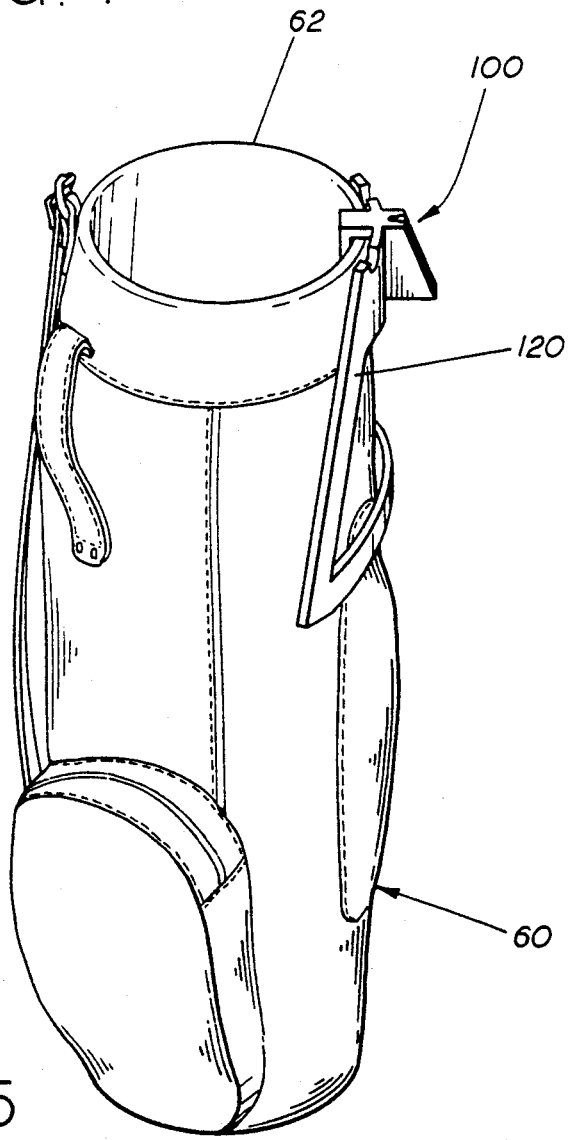
FIG. 5 is a perspective view of the golf club supporting apparatus according to a second embodiment of the present invention attached to a conventional golf club bag.

Referring to FIGS. 5 and 6, a second embodiment of the golf club supporting apparatus, designated generally as 100, is shown attached or clipped to a conventional golf club bag, generally designated as 60. In this embodiment, a base member 120 is curved to correspond with the exterior shape of the golf club bag 60. The curved base member 120 generally conforms to the exterior of the golf club bag 60 which reduces the chances of the supporting apparatus 100 hooking or snagging some object.

It is to be understood that the following description will be described with reference to the base member 20 of the supporting apparatus 10 although the description equally pertains to the base member 120 of the second embodiment 100.

Figure 4:
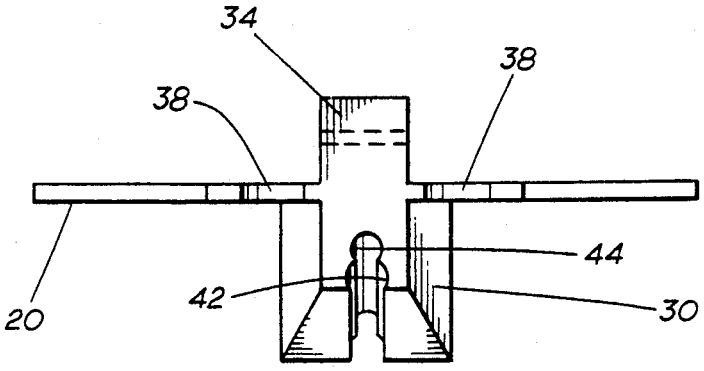
FIG. 4 is a plan view of the golf club supporting apparatus of FIG. 1.

A shaft receiver 30 is connected to the upper portion 24 of the base member 20. As shown in FIG. 4, the shaft receiver 30 includes one or more notched openings 42 and 44 having a diameter sized to the lower portion of the shaft 32A of the golf clubs (FIG. 1). The proper notched opening engages and grips the shaft 32A of the golf club 32.

In the preferred embodiment, the shaft receiver 30 includes two stepped notched openings 42 and 44 as shown in FIG. 4. The notched opening 44 is preferably ⅜ths of an inch in diameter, and the notched opening 42 is preferably 7/16ths of an inch in diameter. It is contemplated that the larger diameter notched opening 42 will be most frequently used for the number 2 through 9 irons and the pitching wedge. The notched opening 44 is preferably used for a putter whose shaft typically has a smaller diameter than the other irons. It is contemplated that only a single flexible notched opening may be used which is adapted to receive all of the various clubs, or three or more notched openings of different sizes may be used.

It is further noted that golf club shafts 32A have a very slight gradual outward taper from the head 32B to the grip 32C. Thus, it may be desirable to make the notched opening 42 or 44 have a corresponding taper along its length.

Referring to FIG. 1, the notched openings 42 and 44 of the shaft receiver 30 have a longitudinal axis (not shown) which preferably forms an angle $\alpha$ of approximately 30 degrees relative to the longitudinal or vertical axis of the base member 20. This allows the lower face of the head 32B of the golf club 32 to rest substantially along the ground when the golf club shaft 32A is engaged by the notched opening 42 or 44 and the base member 20 is supported by the ground. As shown in FIG. 1, the golf club shaft 32A is maintained in a substantially upright position which gives the golf club 32 higher visibility and keeps the golf club grip 32C at substantially waist height, away from damp or wet ground.

Referring to FIGS. 1, 3 and 4, a clip 34 is also connected to the upper portion 24 of the base member 20, preferably opposite the shaft receiver 30. The clip 34 may be attached to the rim 62 of the golf bag 60, as shown in FIGS. 5 and 6, for attachment and easy storage of the golf club supporting apparatus 10. A side view of the clip 34 is shown in FIG. 1. When the golf club supporting apparatus 10 is not in use, the clip 34 may be placed over the top rim 62 of the golf club bag 60 with the base member 20 hanging down on the outside of the bag. According to the second embodiment of the present invention as shown in FIGS. 5 and 6, the base member 20 is preferably curved in shape so that the base member 20 conforms to the golf club bag 60, when hanging from the rim 62 of the golf club bag 60.

Referring to FIGS. 2, 3 and 4, the upper portion 24 of the base member 20 includes one or more recesses 38 which are capable of receiving the shaft 32A of additional golf clubs 32' as shown in FIG. 1. The shaft 32A of the golf club 32' rests in the recess 38 with the head 32B resting on the ground.

USE AND OPERATION

The golf club supporting apparatus 10 initially hangs by the clip 34 from the rim 62 of the golf club bag 60, as shown in FIG. 5. For exemplary purposes, assume that the golfer is in a sand trap just off of the green. The golfer selects two clubs, the putter and sand wedge, from the golf club bag 60. The shaft 32A of the putter near the head 32B is inserted into the notched opening 44, preferably while the golf club supporting apparatus 10 is hanging from the bag 60. With the grip 32C of the putter above the head 32B, the tapered shaft 32A is permitted to slide down in the notched opening 44 until the shaft 32A is firmly gripped by the notched opening 44. The putter and the supporting apparatus 10 is then raised until the clip 34 clears the rim 62 of the golf club bag 60.

The golfer then takes the sand wedge and the putter with the supporting apparatus 10 to the sand trap, placing the putter and supporting apparatus 10 on the ground near the sand trap. After hitting out of the sand trap onto the green, the golfer picks up the putter and the supporting apparatus 10 which is firmly gripped by the notched opening 44. The golfer slides the supporting apparatus 10 down the putter shaft 32A, removes the putter shaft 32A from the notched opening 44, and inserts the sand wedge shaft 32A into the notched opening 42 in the manner as described above. The sand wedge and the supporting apparatus 10 is then placed on the ground near the green while the golfer putts out. The substantially upright position of the golf club 32 in the supporting apparatus 10 as shown in FIG. 1 maintains the club 32 in a highly visible position, keeps the grip 32C off of the ground, and eliminates any stooping or bending over to pick clubs up off the ground. The putter and the sand wedge with the supporting apparatus 10 are then carried back to the golf club bag 60 where the supporting apparatus is removed from the sand wedge shaft 32A and clipped onto the rim 62 of the golf club bag 60 with the clubs being put back into the bag 60.

The foregoing disclosure and description of the invention are illustrative and explanatory thereof, and various changes in the size, shape and materials, as well as in the details of the illustrated construction, may be made without departing from the spirit of the invention.

We claim:

1. A portable golfing aid for supporting a golf club having a shaft with a head at one end, the golfing aid comprising:

a base member including upper and lower portions, said lower portion including a pair of ground engaging points spaced apart a predetermined fixed distance for contacting a ground surface;

a shaft receiver connected to said upper portion including a notched opening dimensioned to receive and grip the shaft of a golf club and oriented such that a golf club having its shaft fully seated in said notched opening is held in a generally upright position when supported only by said pair of spaced apart points and the head of said golf club resting on a ground surface so that the club is held in a highly visible and accessible position which eliminates any stooping or bending over to pick up the gripped golf club; and means on said base member for clipping the golfing aid to a golf bag so as to depend therefrom and be transportable therewith.

2. The golfing aid of claim 1, wherein said shaft receiver receives the golf club shaft at an angle of approximately 30 degrees with respect to said base member.

3. The golfing aid of claim 1, wherein said notched opening is a stepped notch opening having a plurality of stepped diameters to accommodate different golf club shaft diameters and said notched opening grippingly engages the shaft of the golf club and said lower portion of said base member and the golf club head rest on the ground such that the golf club shaft is supported in a partially upright position.

4. The golfing aid of claim 1, wherein said upper portion of said base member includes a recess for supporting a second golf club shaft.

5. The golfing aid of claim 1, wherein said base member is arcuate to substantially conform to the golf bag when clipped thereto.

6. A golfing aid consisting of the elements recited in claim 1.

7. A golfing aid as recited in claim 1 wherein the height of said base member is substantially less than the length of the golf club to be supported thereby.

* * * * *